United States Patent [19]

Kato et al.

[11] 4,340,017

[45] Jul. 20, 1982

[54] STARTING DECOMPRESSION DEVICE FOR A FOUR CYCLE ENGINE

[75] Inventors: Yoshitaka Kato; Kiyotomi Maesaka, both of Wako; Seiichi Matsui, Tokyo; Yoshitoku Iizuka, Urawa, all of Japan

[73] Assignee: Honda Giken Kogyo Kabushiki Kaisha, Tokyo, Japan

[21] Appl. No.: 158,163

[22] Filed: Jun. 10, 1980

[30] Foreign Application Priority Data

Jun. 19, 1979 [JP] Japan ..... 54/77299

[51] Int. Cl.[3] ..... F01L 13/08

[52] U.S. Cl. ..... 123/182; 123/90.16

[58] Field of Search ..... 123/182, 90.15, 90.16, 123/90.17, 345, 347; 74/568

[56] References Cited

U.S. PATENT DOCUMENTS

| | | | |
|---|---|---|---|
| 2,758,580 | 8/1956 | Balzer . | |
| 3,381,676 | 5/1968 | Campen | 123/182 |
| 3,395,689 | 8/1968 | Kruse | 123/182 |
| 3,418,992 | 12/1968 | Anderson et al. | 123/182 |
| 3,897,768 | 8/1975 | Thiel | 123/182 |
| 3,901,199 | 8/1975 | Smith | 123/182 |
| 4,184,468 | 1/1980 | Freyn | 123/182 |

FOREIGN PATENT DOCUMENTS

| | | | |
|---|---|---|---|
| 2842741 | 4/1980 | Fed. Rep. of Germany | 123/90.16 |
| 55-51908 | 4/1980 | Japan | 123/90.16 |

*Primary Examiner*—P. S. Lall

*Attorney, Agent, or Firm*—Armstrong, Nikaido, Marmelstein & Kubovcik

[57] ABSTRACT

There is disclosed a starting decompression device for a four-cycle engine for forcedly open an exhaust valve to decompress a combustion chamber. The starting decompression device includes an interlocking means operatively connected to the exhaust valve, a decompression cam member opposed to the interlocking means, and a return spring for urging the cam member towards an inoperative position at which the exhaust valve is closed. In the device, the cam member is automatically returned, at a suitable time during cranking, to close the exhaust valve, thereby mitigating the initial load of cranking and positively starting the engine.

3 Claims, 6 Drawing Figures

STARTING DECOMPRESSION DEVICE FOR A FOUR CYCLE ENGINE

BACKGROUND OF THE INVENTION

The present invention relates to an improvement in a starting decompression device for four-cycle engines, which in effecting cranking for starting the engine manually by use of a kick pedal, a starter rope or the like, can forcedly open an exhaust valve to decompress the interior of a combustion chamber for facile achievement of cranking.

Such devices as known are designed so that the exhaust valve of the engine is forcedly opened by opertion of a swing arm. However, in the present invention, the swing arm must be returned to release a force opening of the exhaust valve at the proper time when rotation of the crank shaft is accelerated during the cranking of the engine. However, such a return operation is cumbersome and requires skill to be accomplished.

In view of the foregoing, the present invention has as its object the provision of a device as described above, which is simple and easy to operate and is simply built, wherein a cam member is used to forcedly open an exhaust valve, and the cam member is automatically operated for return at a suitable time during cranking to close the exhaust valve, thus reducing the initial load of cranking and positively starting the engine.

Other objects and features of the invention will become apparent from the following description and claims, as illustrated in the accompanying drawings.

SUMMARY OF THE INVENTION

In a four-cycle engine having (a) an inlet valve and an exhaust valve for respectively opening and closing an inlet port and an exhaust port which ports are in communication with a combustion chamber, and (b) a valve-operating mechanism for controllably opening and closing said valves, a starting decompression device for the four cycle engine, comprising: an interlocking means operatively connected to said exhaust valve; a decompression cam member opposed to said interlocking means and being movable between an operative position in which said exhaust valve is opened halfway and in inoperative position wherein said exhaust valve is closed; and a return spring for urging said decompression cam member towards said inoperative position, said decompression cam member being brought into engagement with said interlocking means against the force of said return spring when said exhaust valve is opened by said decompression cam member, whereby said decompression cam member is disengaged when said exhaust valve is opened by said valve operating mechanism.

BRIEF DESCRIPTION OF THE DRAWINGS

FIGS. 4 and 5 are diagrams helpful in the explanation of the relation between a decompression cam member and a pressure receiving convex of a rocker arm on the exhaust valve side, FIG. 4 showing the relation therebetween, with the decompression cam member placed in an inoperative condition, whereas FIG. 5 illustrates the relation therebetween with said member in an operative condition.

DESCRIPTION OF THE PREFERRED EMBODIMENTS

Figure 1:
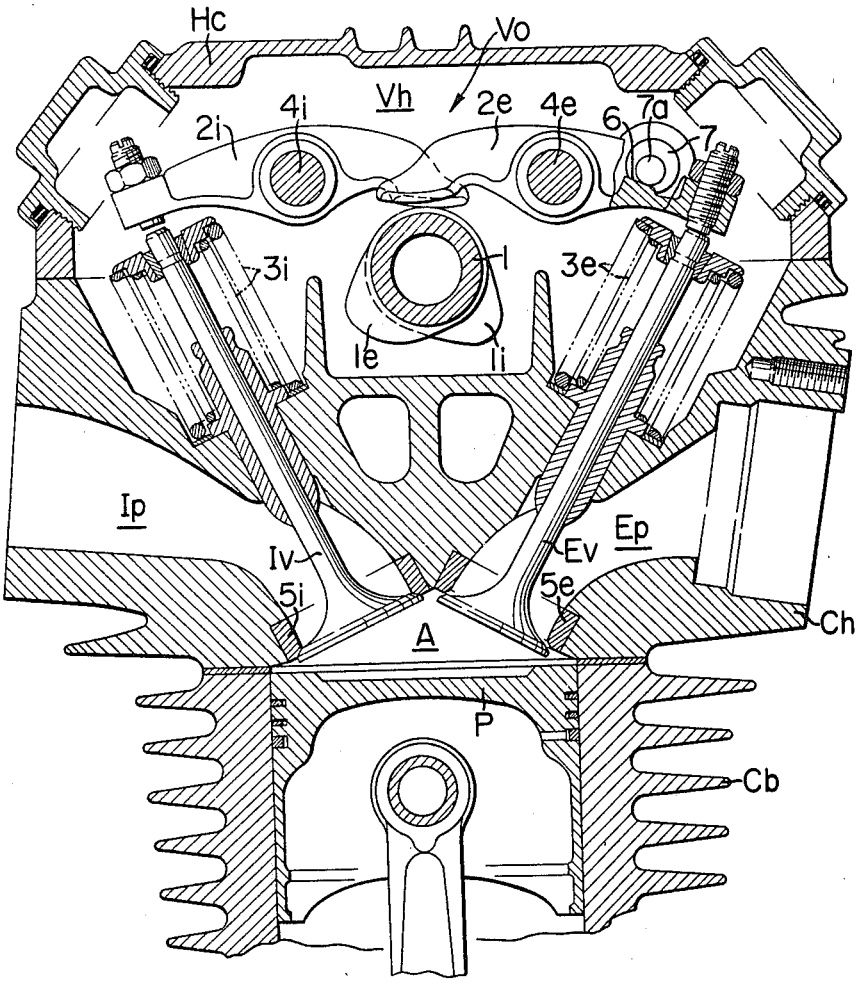
FIG. 1 is a longitudinal sectional view of an essential portion of the engine.

Turning now to FIG. 1, there is shown a principal part of a four cycle single cylinder engine which is provided with a cylinder block Cb, housing therein a piston P and a cylinder head Ch joined to the upper end of the cylinder block Cb to form a combustion chamber A above the piston P, the cylinder head Ch having an inlet valve Iv and an exhaust Ev for opening and closing an inlet port Ip and an exhaust port Ep, respectively, both of which are open to the combustion chamber A. In a valve housing Vh formed between the cylinder head Ch and a head cover Hc joined to the upper end of the cylinder head Ch, a valve operating mechanism Vo for controllably opening and closing these valves Iv and Ev is constructed.

The valve operating mechanism Vo comprises a cam shaft 1 disposed in the central portion between both valves Iv and Ev, two rocker arms **2*i* and 2*e* adapted to provide connection between intake and exhaust cams 1*i*, 1*e* on the cam shaft 1 and inlet and exhaust valves Iv and Ev, respectively, and valve springs 3*i* and 3*e* for biasing the intake and exhaust valves Iv and Ev, respectively, in their closing direction, the cam shaft 1 being driven at a reduction ratio of one-half by means of a crank shaft (not shown) of the engine. In the drawing, reference numeral 4*i* and 4*e* designate pivot shafts of the rocker arms 2*i* and 2*e*, respectively, and 5*i* and 5*e*** designate valve seats for the inlet and exhaust valves Iv and Ev, respectively.

Figure 6:
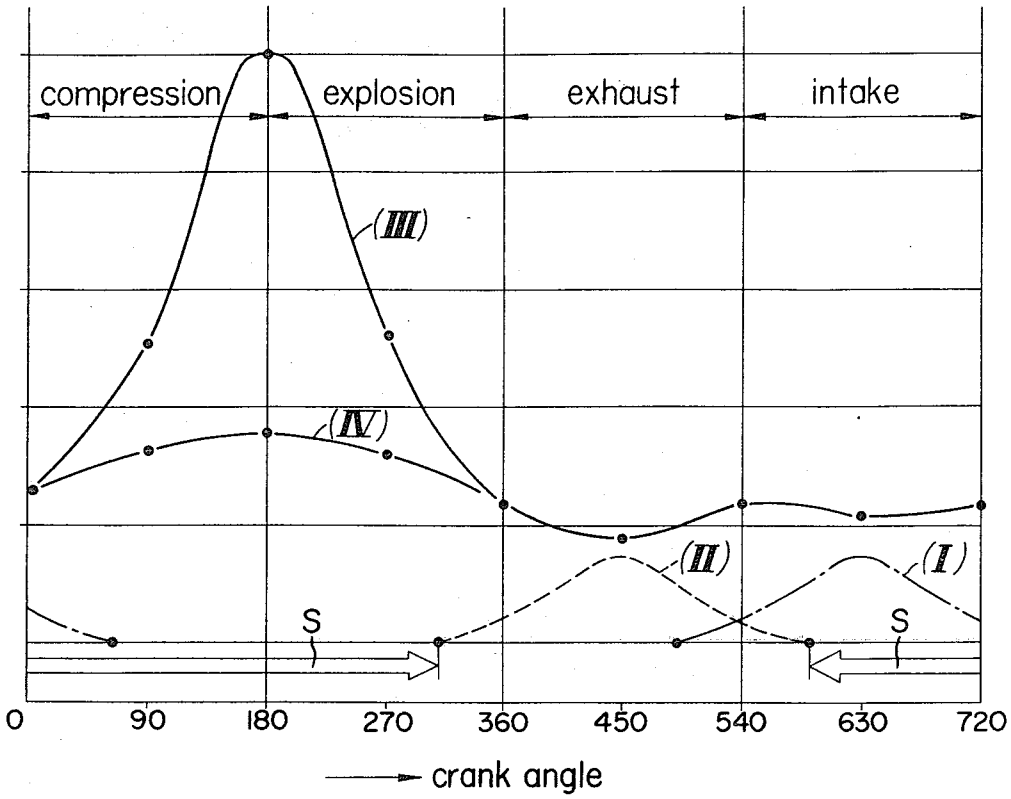
FIG. 6 is a graphic representation showing various characteristics relative to a crank angle of the engine, lines (I) and (II) showing the opening timing of inlet and exhaust valves, respectively; line (III) showing normal starting torque of the engine; and line (IV) showing the starting torque in the case the decompression cam member is actuated.

Thus, the valve operating mechanism Vo is provided to controllably open and close the intake and exhaust valves Iv and Ev at timing as shown by the lines (I) and (II) in FIG. 6, and is operated in a manner known in the art.

Figure 2:
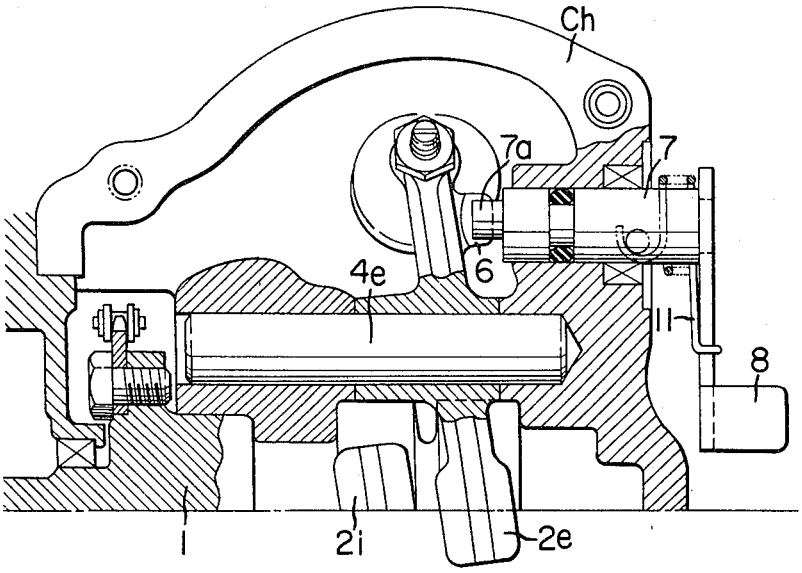
FIG. 2 is a sectional view taken on line II—II of FIG. 1.
Figure 3:
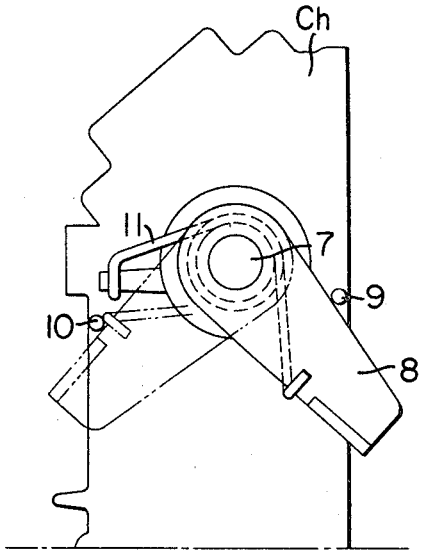
FIG. 3 is a side view of FIG. 2.

As may be best shown in FIGS. 2 and 3, the rocker arm **2*e* for the exhaust valve Ev is integrally formed with a pressure receiving convex 6 on one side of an arm thereof extending towards the exhaust valve Ev and, sidewardly of the convex, a decompression cam member; that is, a cam shaft 7 is rotatably supported on the cylinder head Ch substantially parallel to the pivot shaft 4*e* of the rocker arm 2*e*. The decompression cam shaft 7 has at its inner end an eccentric pin 7*a* as a cam whose side is opposed to the upper surface of said pressure receiving convex 6 and, also, has at its outer end an operating laver 8 fixedly mounted thereon. A pair of stoppers 9 and 10 are spaced apart on the cylinder head Ch with the operating lever 8 placed therebetween, one stopper 9 being a retraction limit stopper for controlling the inoperative position of the operating lever 8, the other stopper 10 being an operation limit stopper for controlling the operating position thereof, the operation lever 8 having a return spring 11 in the form of a coiled torsion spring for urging the lever against the retraction limit stopper 9**.

Figures 4, 5:
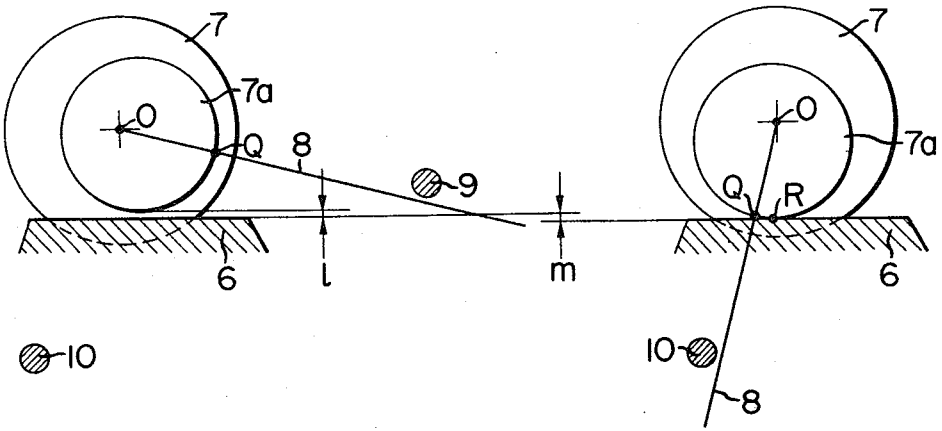

Next, with reference to the relation between the eccentric pin *7a* of the decompression cam shaft 7 and the pressure receiving convex surface 6 of the rocker arm *2e* in connection with FIGS. 4 and 5, FIG. 4 shows the inoperative condition of the decompression cam shaft 7 in which the operating lever 8 bears on the retraction limit stopper 9. In this condition, an apex Q of the eccentric pin *7a* (a point which is farthest from the center 0 of the decompression cam shaft 7 on the peripheral surface of the eccentric pin *7a*) is positioned greatly away from the pressure-receiving convex surface 6 on the right hand of the decompression cam shaft 7. Even when the pressure-receiving convex surface 6 is at its upper limit position during the closure of the exhaust valve Ev, the eccentric pin *7a* is opposed to the upper surface of the pressure receiving convex surface 6 leaving a given clearance l. This prevents interference of the eccentric pin *7a* with respect to the swinging of the rocker arm *2e* during the running of the engine.

FIG. 5 shows the operative condition of the decompression cam shaft 7 in which the operating lever 8 pivots to a position at which the lever 8 bears on the operation limit stopper 10. In this condition, the eccentric pin *7a* engages the upper surface of the pressure receiving convex surface 6, and the apex Q occupies a position slightly offset to the left beyond a contact point R with respect to the pressure-receiving convex surface 6, whereby the pressure receiving convex surface 6 is forced down a given amount m from the upper limit position to half-open the exhaust valve Ev as shown in FIG. 1. In this case, the return spring 11 is designed so that the spring action of the valve spring *3e* causes a relatively great frictional force to be generated in a contact surface between the eccentric pin *7a* and the pressure receiving convex surface 6, and the frictional force causes the decompression cam shaft 7 to be engageably retained at the aforesaid operative position against the force of the return spring 11 of the operating lever 8.

When the apex Q of the eccentric pin *7a* is set to a point beyond the contact point R with respect to the pressure-receiving convex surface 6, as previously mentioned, the eccentric pin *7a* causes the pressure-receiving convex surface 6 to be forced down slightly to increase the frictional force in the contact portion until the apex Q reaches the contact point R during the return cycle of the operating lever 8 and, accordingly, it is possible to more positively bring the decompression cam shaft 7 into engagement with the convex surface 6 so as to be held at the operating position. In addition, such engagement may be achieved more effectively, for example, by forming the contact surface with rugged portions such as serrations.

To start the engine, first, the operating lever 8 is manually forced to turn against the force of the return spring 11 until the former bears on the operation limit stopper 10 and then is released by removal of the manual force.

At this time, if the exhaust valve Ev is in a closed state, the pressure-receiving convex surface 6 is in its upper limit position and, thus, as previously mentioned, the eccentric pin *7a* causes the convex surface to be forced down to open the exhaust valve Ev halfway and the eccentric pin *7a* is locked at its operative position by the frictional force with respect to the pressure-receiving convex surface 6.

Accordingly, next, when the kick pedal or starter rope is operated for the cranking of the engine, compressed gas within the combustion chamber A is discharged into the discharge port Ep at the outset and, consequently, the starting torque is small and rotation of the crank shaft of the engine may be easily accelerated. When the engine reaches its exhaust stroke, the exhaust cam *1e* causes the exhaust valve Ev to be opened through the rocker arm *2e* and, as a result, as soon as the rocker arm *2e* is clear of the eccentric pin *7a*, the decompression cam shaft 7 is released from its engagement and then automatically rotated to the inoperative position by the force of the return spring 11 of the operating lever 8.

In this way, the engine is started by the inertia rotation of the crank shaft via regular strokes.

Also, in a condition where the engine is stopped with the exhaust valve Ev opened, the pressure-receiving convex surface 6 is already fully moved down by the action of the exhaust cam *1e* and, consequently, when the decompression cam shaft 7 is rotated to the operative position, it is not possible to provide engagement between the eccentric pin *7a* and the pressure-receiving convex surface 6. This means that the decompression cam shaft 7 need not be operated. Thus, in this case, the engine can be easily cranked while the operating lever 8 remains returned to the inoperative position.

As shown in FIG. 6, since the effective operating range S of the decompression cam shaft 7 extends to entire engine strokes except the opening period of the exhaust valve Ev, no inconvenience occurs during the first four strokes of the engine. In particular, normal starting torque of the engine indicates a peak value at the end of compression stroke as shown by the line (III); however, the aforesaid peak value may be considerably reduced as shown by the line (IV) by the operation of the decompression cam shaft 7, resulting in a noticeable decompression effect.

It should be noted in the present invention that the decompression cam member employed may be of the slidable type in place of the rotatable type which appears in the above-described embodiments; those operated by the decompression cam member may include one operatively connected to the exhaust valve to force-open the latter, in place of the rocker arm *2e*.

As described above, in accordance with the present invention, the decompression cam member for forcibly opening the exhaust valve can be locked to the operative position when the engine is started and, at a suitable time during the next cranking, the decompression cam member can be automatically returned to the inoperative position and, therefore, it is possible to mitigate the initial load of cranking to effect nimble cranking operation, to positively stare the engine, and to prevent a starting miss caused by the delay of the return timing of the decompression cam member. Thus, the engine may be started in a simple and easy manner without requiring particular skill, and, in addition, there is afforded effects that may provide an apparatus which is very simple in construction and is inexpensive.

As many apparently widely different embodiments of this invention may be made without departing from the spirit and scope thereof, it is to be understood that the invention is not limited to the specific embodiments thereof except as defined in the appended claims.

We claim:

1. In a starting decompression device for a four-cycle engine including an inlet valve and an exhaust valve for respectively opening and closing an inlet port and an exhaust port which ports are in communication with a combustion chamber and a valve-operating mechanism having an intake rocker arm and an exhaust rocker arm for controllably opening and closing said valves, said starting decompression device comprising:

a decompression cam member disposed adjacent said exhaust rocker arm and being movable between an operative position wherein said exhaust valve is opened halfway and an inoperative position wherein said exhaust valve is closed; and a return spring for urging said decompression cam member towards said inoperative position;

the improvement wherein said exhaust rocker arm has a cam follower for camming engagement with said decompression cam member, and said decompression cam member has a cam apex which is placed in a position past a contact point of said decompression cam member with said cam follower when said decompression cam member is in the operative position.

2. The starting decompression device as recited in claim 1 in which said decompression cam member comprises a cam shaft rotatable between said operative position and said inoperative position.

3. A starting decompression device according to claim 1, wherein said decompression cam member comprises a decompression cam shaft and a cylindrical pin formed thereon in eccentric relation to the central axis thereof, said cam follower being integrally formed with said exhaust rocker arm at its one side in opposing relation with said pin.

* * * * *